US005345624A

United States Patent [19]

Brown, III

[11] Patent Number: 5,345,624

[45] Date of Patent: Sep. 13, 1994

[54] ADJUSTABLE SHOWER CURTAIN POSITIONING ARM

[75] Inventor: Thomas G. Brown, III, 1801 Francisco, Berkeley, Calif. 94703

[73] Assignee: Thomas G. Brown, III, Berkeley, Calif.

[21] Appl. No.: 31,273

[22] Filed: Mar. 15, 1993

[51] Int. Cl.[5] ..... A47K 3/22

[52] U.S. Cl. ..... 4/610; 248/231; 81/64; 81/3.43; 4/661

[58] Field of Search ..... 4/610, 661, 558, 605, 4/609, 599, 614, 608, 559; 160/330, 349.2, DIG. 6; 248/231, 231.3, 58, 74.3, 214; 403/392, 396, 236, DIG. 9; 24/16 R, 19, 282; 81/3.43, 64, 65

[56] References Cited

U.S. PATENT DOCUMENTS 575,694 1/1897 Burnes ..... 81/65
1,478,724 12/1923 Barchus ..... 81/3.43
2,554,106 5/1951 Heubeck ..... 4/610
2,573,985 11/1951 Porter ..... 4/610
3,872,520 3/1975 Tyconick ..... 4/610
4,350,063 9/1982 Koehler ..... 24/279
4,532,833 8/1985 Downs ..... 81/64
4,715,844 12/1987 Fambrough ..... 81/64
5,169,107 12/1992 Morley ..... 248/231

*Primary Examiner*—Henry J. Recla
*Assistant Examiner*—Gregory Vidovich

[57] ABSTRACT

A shower curtain support arm which mounts on a shower rod without inhibiting the sliding movement of the curtain, and when locked in position controls the position of the shower curtain to hold the curtain away from a bather. The shower curtain support arm is locked into position by manipulating the end of the support arm,

4 Claims, 5 Drawing Sheets

ADJUSTABLE SHOWER CURTAIN POSITIONING ARM

BACKGROUND OF THE INVENTION

1. Field of the Invention

The present invention relates to an adjustable curtain support, and more specifically relates to an adjustable shower curtain support arm for positionally controlling a shower curtain so as to prevent the inward movement of the curtain toward a bather.

2. Description of the Related Art

The tendency of a shower curtain, when in use., to move inward toward a bather is well known. This inward movement of a shower curtain is due, at least in part, to the draft or convection air current created by the very warm air on the inner side of the shower curtain, said warm air being heated by the warm water spraying from a shower head, and the relatively cooler air present on the outer side of the shower curtain.

Several attempts have been made to prevent the aforesaid inward movement of a shower curtain by retrofitting the curtain rod with a curtain support and the like. U.S. Pat. No. 3,872,520 (Tyconik, 1975) discloses a curtain support for holding the shower curtain away from a bather by means of four arm-like members extending downward and outward in a fan-like array from the curtain rod supporting the curtain. This arrangement has various disadvantages inasmuch as it requires the drilling of a hole in the curtain rod to place a set pin, the long fan-like support arms may present a hazard as a bather enters and exits the shower enclosure, and this design requires the simultaneous use of two hands of someone of above average height to remove the device.

U.S. Pat. No. 2,774,974 (Zaloga, 1955) discloses a curtain rod attachment for supporting a shower curtain and increasing the area enclosed by the shower curtain. This arrangement also has numerous disadvantages in that the thumbscrew device used to attach the support member to the curtain rod inevitably disfigures and damages the rod which is formed of a very thin-walled material, i.e., 1/32 inch (0.7937 cm) tube wall thickness, via the force applied to the curtain rod when the thumbscrew is tightened. This arrangement further requires the simultaneous use of two hands of someone of above average height to remove the device when a bather enters and exits the shower enclosure. U.S. Pat. No. 5,007,120 (Annand, 1991) discloses a shower curtain control device which appears to allow the curtain, which may comprise an inner liner and an outer curtain, to be slidably opened and closed with relative ease, but this arrangement has the disadvantage of being rather unwieldy and large in size. Furthermore, this device is held in a stationary operating position by means of a counter weight which interferes with and restricts the normal activities of bathers of above average height so as to be a nuisance, particularly when a plurality of such devices are used as recommended in the preferred embodiment.

All of the aforesaid devices are difficult to move aside with the shower curtain to allow access of a bather to the shower enclosure. Furthermore, all of the aforesaid devices are relatively large in size and substantial weight and suggest the use, at least in part, of metal in their construction, which increases the costs involved in manufacturing, shipping and handling said devices.

OBJECTS AND ADVANTAGES OF THE INVENTION

A main object of the present invention is to eliminate the previously described disadvantages and provide an adjustable shower curtain support arm for positionally controlling a shower curtain so as to prevent the inward movement of the curtain toward a bather.

A further object of the invention is to provide an adjustable shower curtain support arm for a shower curtain of a type suspended from a curtain rod which is slidably movable along the curtain rod, and which allows both rotational pivoting and sliding movement of the curtain support arm on said rod.

An even further object of the present invention is to provide an adjustable shower curtain support arm for positionally controlling a shower curtain which can be easily locked and unlocked to the curtain rod with a single hand.

A still further object of the invention is to provide an adjustable shower curtain support arm which can be locked and unlocked to curtain rod by only manipulating an end of the curtain support arm.

These objects of the present invention are achieved by providing an adjustable shower curtain support arm comprising:

- a mounting means having a flexible member extending on one side of a housing which opens to accommodate a curtain rod in an open state and closes to encircle said rod in a closed state, and allows both rotational pivoting and sliding movement of the curtain support arm on said curtain rod in said closed state;
- a locking means including a U-shape defining a rod-accommodating portion which is slidably movable within an area of said housing; and
- an elongated member, one end of which is accommodated by an opening in said housing, and the other end of which engages the shower curtain at a location between the curtain rod and the approximate midline of the curtain.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

Figure 1:
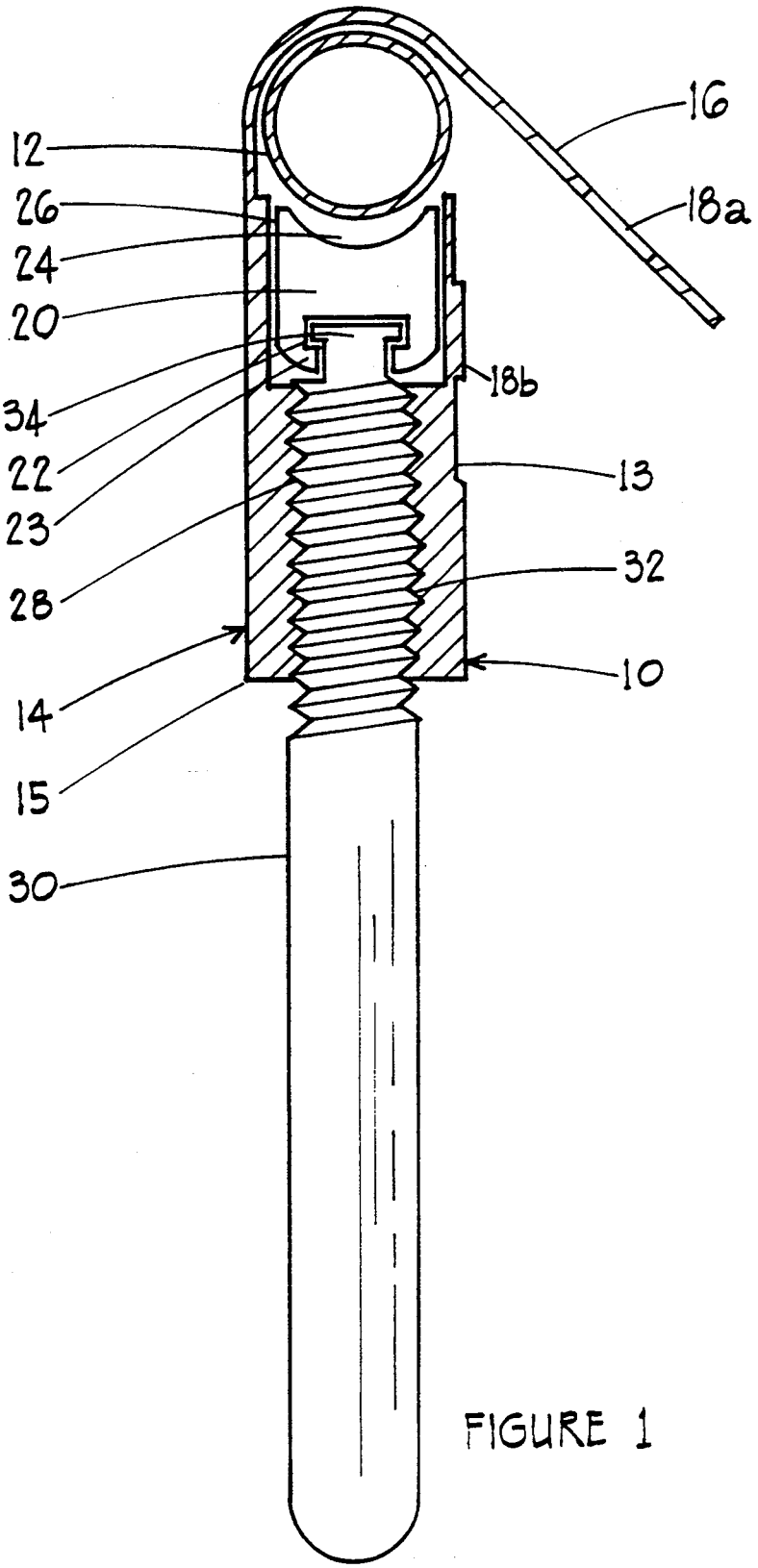
FIG. 1 is a section view showing an embodiment of the adjustable shower curtain support arm of the present invention attached to a shower curtain rod.

Listing of reference numerals:

10) shower curtain support arm of the present invention;
12) shower curtain rod;
13) recess;
14) housing;
15) body;
16) flexible mounting member;
18) snap;
**18*a***) snap receptor;
**18*b***) snap key;
20) strike;
22) slotted face of strike;
23) flanges;
24) U-shaped face for receiving curtain rod;
26) shaft in housing permitting strike movement;
28) threaded shaft in housing for receiving threaded end of support arm;
30) elongated member;
32) threaded end of elongated member;
34) boss;
36) shower curtain;
38) tub rim;
42) shower enclosure;
44) typical shower curtain (unsupported);
46) notches on flexible mounting member;
48) ball;
50) socket;
54) channel.

DESCRIPTION OF THE PREFERRED EMBODIMENTS

A preferred embodiment of the present invention is shown in FIG. 1. The adjustable curtain support arm 10 comprises a housing 14, strike 20, and elongated member 30. The housing 14 is formed of a plastic material such as polyvinyl chloride and the like, and constitutes a rectangular body 15 which has a threaded portion 28 on the interior side thereof, and a flexible strap portion 16 which is wrapped around a curtain rod 12 of any standard diameter. The strike 20 has an overall rectangular shape and floats freely within the rectangular shaft 26 formed in the housing 14. One end of the strike 20 has a U-shaped receptor portion 24 which is capable of receiving a curtain rod of any standard diameter, and the opposite end of the strike 20 has a slotted portion 22 formed as an elongated notch provided on two sides with flanges 23. The elongated member 30 is cylindrical in shape, approximately 10–30 inches in length and has a threaded portion 32 at one end which engages the threads formed in the threaded portion 32 of the housing 14. The end of said elongated member 30 having the threaded portion 28 is also provided with a disk-like boss 34, which fits into the slotted portion 22 of the strike 20. The housing 14 accommodates the strike 20 and the elongated member 30.

When a shower curtain 36 is installed via rings or clips on a shower curtain rod mounted horizontally over the entrance to a shower enclosure so as to allow said rings or clips to move freely along the shower rod to open and close the shower curtain and the curtain is in the closed position in preparation for a shower, the flexible strap portion 16 of the housing 14 is wrapped around the curtain rod 12 in the approximate center thereof between any two of said rings or clips, and the snap 18 which comprises a rectangularly shaped slot-like opening, i.e., snap receptor, **18*a* formed at the terminal end of the flexible strap portion 16 is locked via thumb pressure in the closed position on the snap key 18*b* which is formed on the body 15 of the housing 14. In a preferred embodiment, two adjustable shower curtain support arms 10 are disposed at approximate equidistant intervals along the shower rod 12. The shower curtain support arms 10 can be mounted on the shower rod 12 when the shower curtain 36 is fully extended across the shower enclosure, without the necessity of removing the rod 12 from the wall mounting brackets, or removing the curtain attaching rings or clips from the rod 12**.

Figure 4:
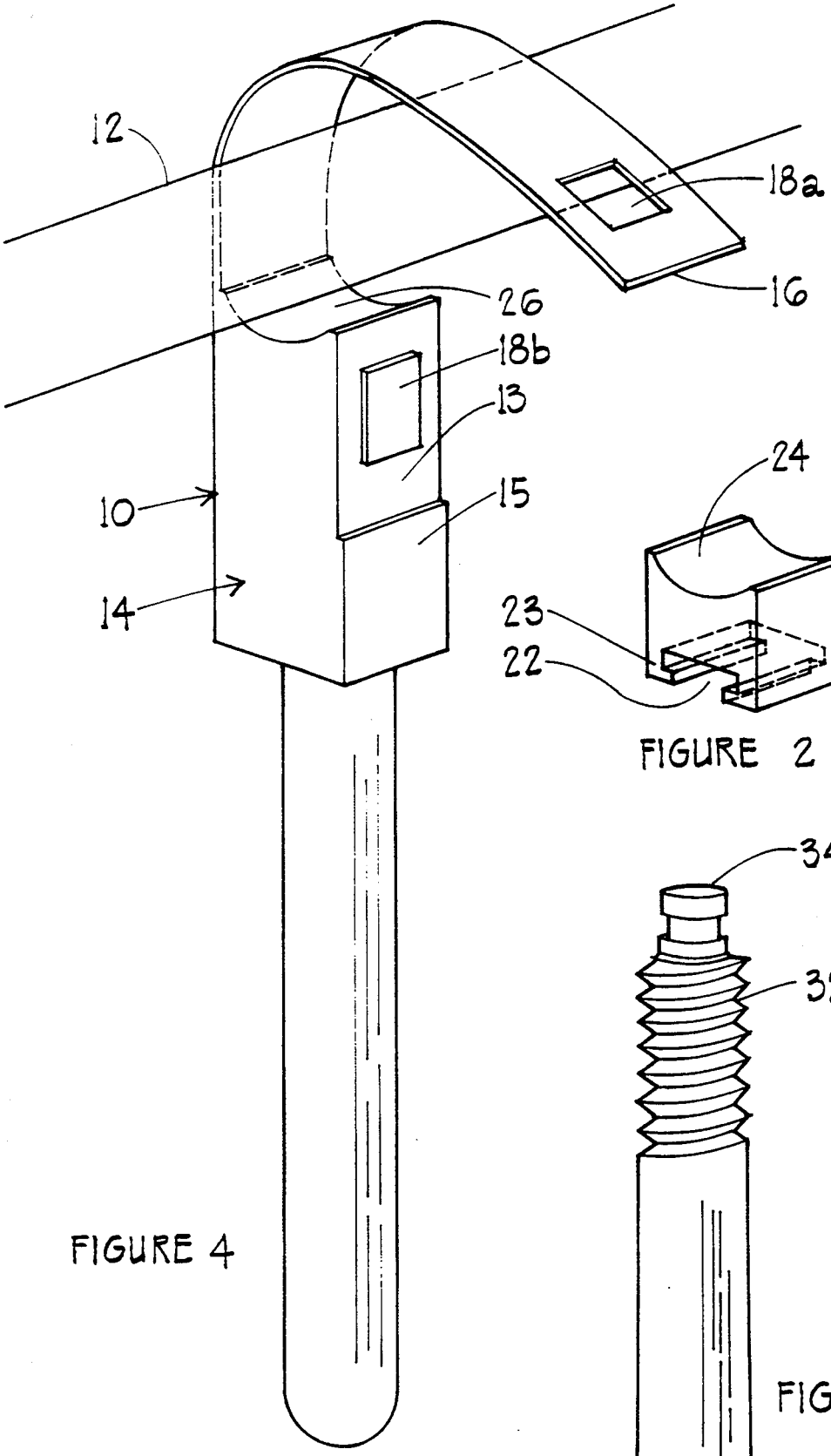
FIGS. 4 is a perspective view showing the mechanism for attaching the adjustable curtain support arm to the curtain rod.
Figure 2:
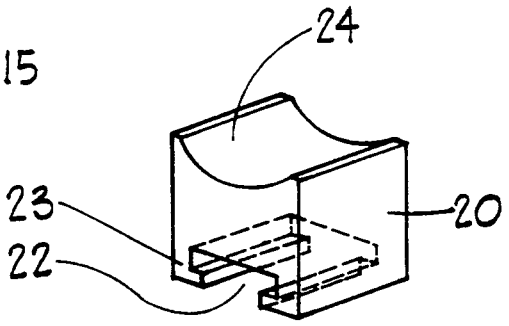
FIG. 2 shows details of the construction of the strike.
Figure 3:
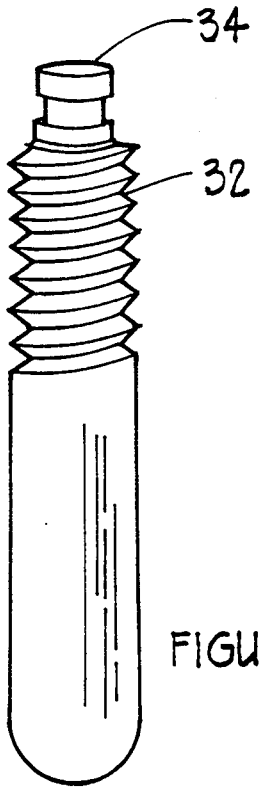
FIG. 3 shows end of the support arm accommodated within the housing, and the boss which engages the strike.

The snap 18 comprises a snap key **18*b* which is a protruding member integrally formed on a recessed portion 13 of the body 15 and has a configuration which precisely engages the snap receptor 18*a*, as shown in FIGS. 1 and 4. The recessed portion 13 is recessed to a depth equal to the thickness of the flexible strap 16, such that said flexible strap portion 16 fits flush with the exterior surface of the body 15 when in the locked, i.e., closed position. After the snap receptor 18*a* has fully engaged the snap key 18*b* via thumb pressure such that the flexible strap portion 16 is locked in the closed position and wrapped loosely around the curtain rod 12, the elongated member 30 of the curtain support arm 10 assumes via the force of gravity a substantially vertical orientation suspended from the curtain rod 12, more or less parallel to the shower curtain 36 and at a right angle relative to the shower rod 12**.

In this state, the shower curtain 36 may be opened and closed without interference from the adjustable shower curtain support arms 10 of the present invention, which slides freely along the curtain rod 12 with the aforesaid rings or clips. When the shower curtain 36 is in the open position, i.e., when the shower curtain is pushed to a terminal end of the curtain rod 12 adjacent to a wall or the like, the curtain support arms 10 move along the rod 12 in concert with the movement of the shower curtain. The curtain support arms 10 thus do not hinder or interfere with the entry and exit of a bather.

When the shower curtain 36 is in the closed position, i.e., drawn across the opening to the shower enclosure 42 along the shower rod 12 in preparation for a shower, the adjustable shower curtain support arms 10 travel with the shower curtain 36 and the rings or clips attaching the curtain to the shower rod 12. As the curtain is fully extended, the adjustable shower curtain support arms 10 assume positions at approximate equidistant intervals along the shower rod 12 (refer to FIG. 6).

With the shower curtain 36 in the closed state, a bather grasps the elongated member 30 and manually swings the adjustable shower curtain support arm 10 outwardly from the shower enclosure 42 on the shower rod 12, i.e., the shower curtain support arm 10 pivots upon the shower rod 12, until a suitable angle of projection is achieved. At this time, the elongated member 30 is in a position similar to that shown in FIGS. 5 and 6, and supports the upper half portion of the shower curtain 36 outwardly away from the inward-from-vertical orientation of the shower curtain 44 indicated by the dashed line in FIG. 5, and increasing the area enclosed by the curtain thereby.

With the adjustable shower curtain support arm 10 extended outwardly as described above, a bather then manually rotates the elongated member 30 in an axial direction so as to screw the threaded portion 32 of the elongated member 30 into the threaded portion 28 of the housing 14. The strike 20, slot 22 of which accommodates the disk-like boss 34 provided at the terminus of the threaded portion 28 of the elongated member 30, is driven upwardly via the screwing motion of the rotating elongated member 30 so as to produce a tightening action of the strike 20 relative to the shower rod 12 until the U-shaped receiving portion 24 of said strike 20 is pressed against the shower rod 12. At this time, a bather becomes tactilely aware of the increasing resistance to the applied rotation of the elongated member 30 and stops the rotation of said elongated member 30. Accordingly, the adjustable shower curtain support arm 10 is held stationary by means of the pressure exerted by the U-shaped receiving portion 24 on the shower rod 12 and the friction produced therebetween and the friction produced between said rod 12 and the flexible strap 16. The aforesaid threaded portions 28 and 32 should be of a coarseness, i.e., pitch, sufficient to achieve the aforesaid pressure and friction between the strike 20 and the rod 12, preferably in less than several full turns, and ideally in less than one full turn of the elongated member 30. Advantageously, the positioning and locking of the adjustable shower curtain support arm 10 can be accomplished by using just one hand to manipulate the elongated member 30 only.

Figure 5:
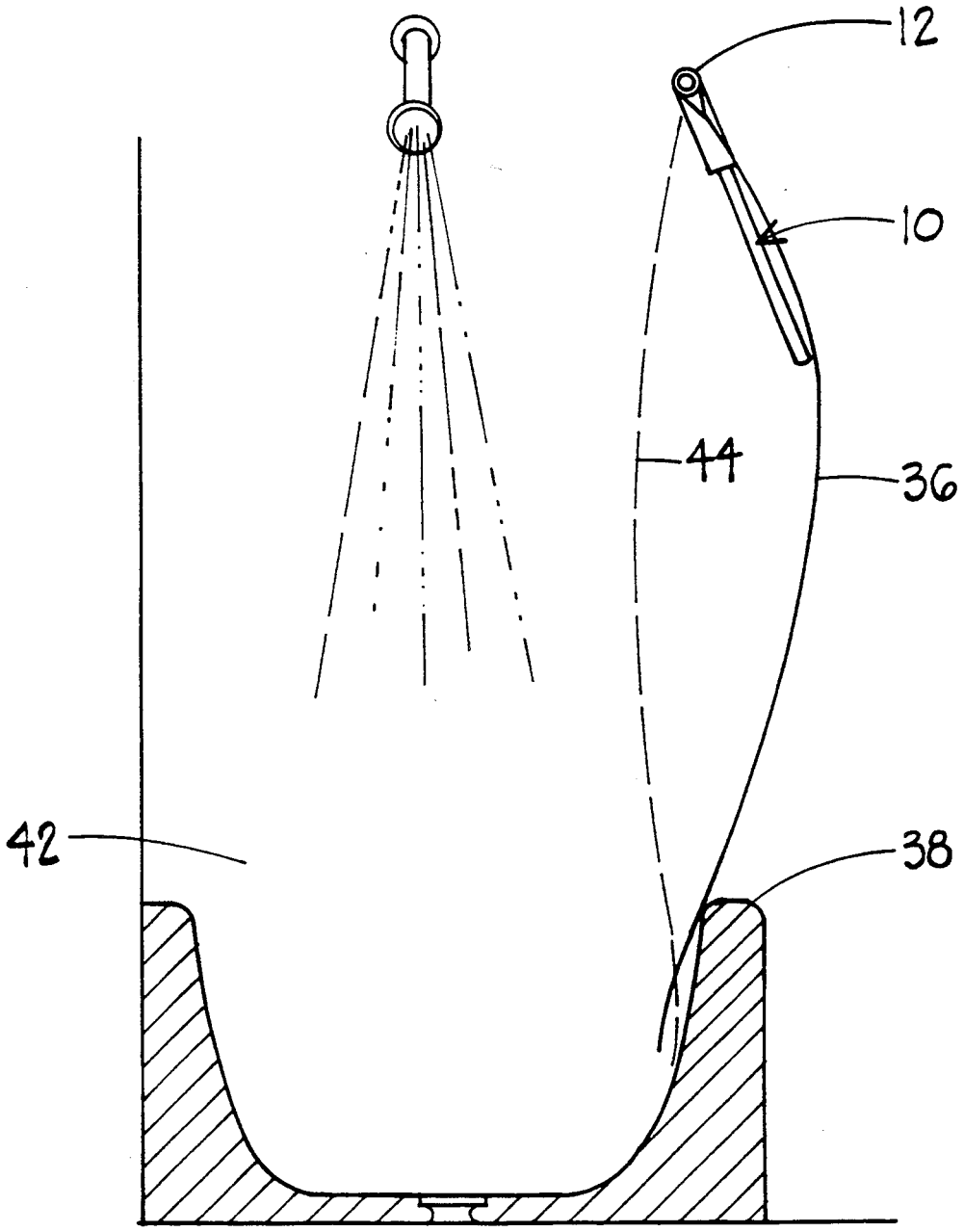
FIG. 5 is a section view showing an embodiment of the adjustable shower curtain support arm of the present invention in an operating position attached to a shower curtain rod, with the typical effect of an unsupported curtain indicated by dashed lines and the position of the shower curtain supported by the present invention indicated by solid lines.
Figure 6:
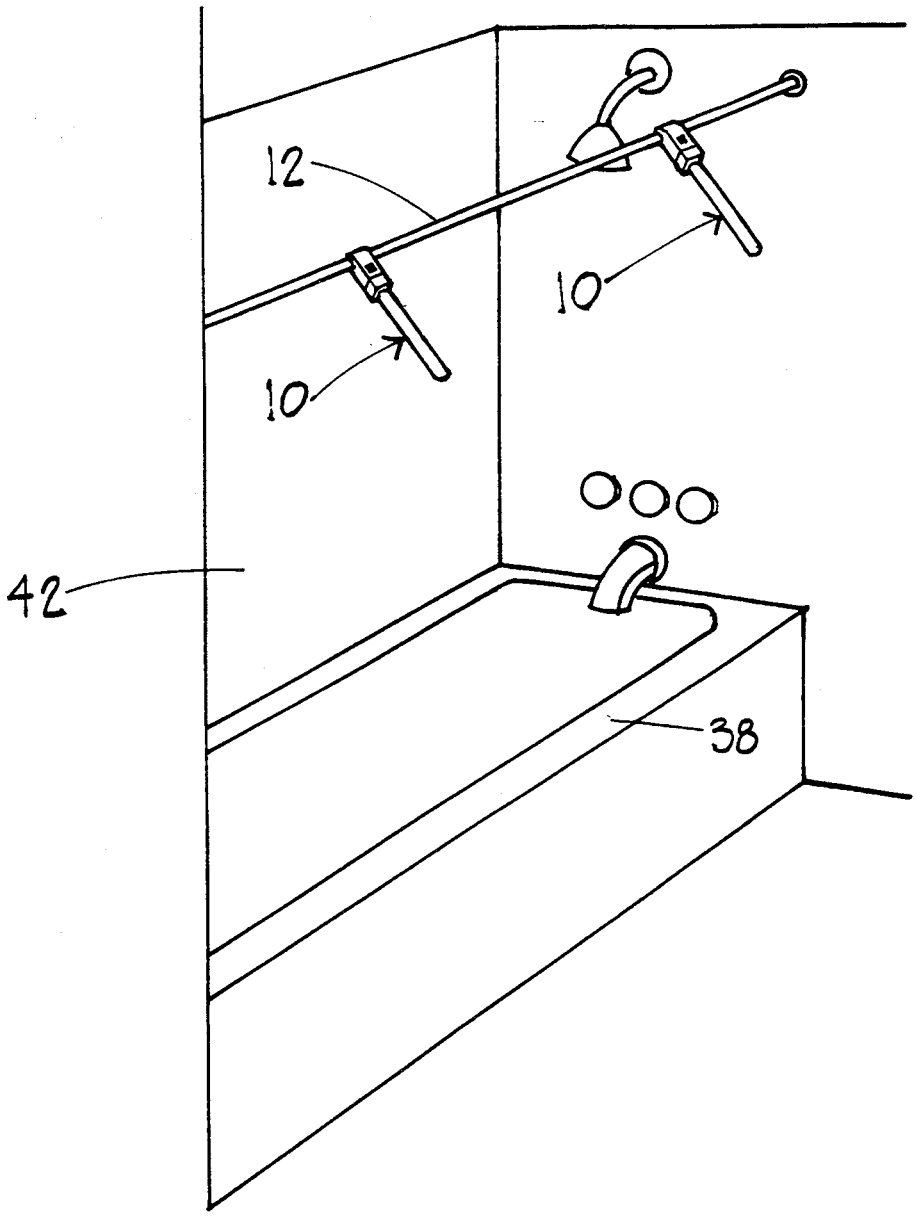
FIG. 6 is a perspective view of a typical shower enclosure showing optimum disposition of the shower curtain support arm.

The adjustable shower curtain support arm 10 is at this time in the extended operating position shown in FIGS. 5 and 6, and supports the upper half of the shower curtain outwardly from the shower enclosure 42 to prevent the previously described convection air current from blowing the shower curtain inward and into contact with a bather, such as is described by the dashed line in FIG. 5. This arrangement maintains the shower curtain 36 in a stable condition and affords a bather extra maneuvering room. The adjustable shower curtain support arm 10 is adjustably positionable at any reasonable angle to support the shower curtain away from a bather and need not be set at any single definite angle to achieve a desired effectiveness. The adjustable shower curtain support arm 10 may have an overall length of about 10–30 inches, with the optimal length being determined by the height of the intended bather. Therefore, the elongated member 30 may be provided in various lengths, preferably in a range of 10–30 inches, to accommodate bathers of different heights and/or postures (i.e., standing or sitting).

When the shower is completed, the adjustable shower curtain support arm 10 is released from the operating position by turning the elongated member 30 in the opposite direction to the aforesaid direction of rotation which produces a tightening action, so as to release the pressure exerted by the U-shaped receiving portion 24 of the strike 20 on the shower rod 12. The adjustable shower curtain support arm 10 then naturally assumes the previously described vertical orientation and is capable of moving smoothly along the shower rod 12 when the shower curtain is slidingly moved to the open position, i.e., when the curtain is pushed to a terminal end of the curtain rod 12 adjacent to a wall or the like. Advantageously, this release of the adjustable shower curtain support arm 10 can be accomplished using only one end of the elongated member.

The pressure exerted by the U-shaped receiving portion 24 of the strike 20 on the shower rod 12 by means of the tightening action produced via the axial rotation of the elongated member 30 is sufficient to hold the adjustable shower curtain support arm 10 stationary, but is not so strong as to damage or deface the curtain rod 12. Adequate pressure to hold the curtain support arm 10 stationary in the operating position can be produced, preferably in less than several full turns, and ideally in less than one full turn of the elongated member 30 by a bather of less than average height and strength using only one hand, or simply two fingers and thumb, or two fingers and palm. In the event excessive pressure is inadvertently applied, the configuration of the U-shaped receiving portion 24 of the strike 20 and the flexible strap 16 as well as the plastic construction material of said members effectively prevents damage and disfigurement to the shower rod 12.

According to the preceding description, the adjustable shower curtain support arm 10 of the present invention can be easily operated by persons having physical disabilities, including disabilities of the fingers, hands and arms. Furthermore, the device of the present invention can be readily positioned and operated by persons with physical disabilities which require that they sit on an elevated platform or chair within the shower enclosure 42. A standing bather could use a shorter overall length, whereas a sitting bather would require a longer overall length of the adjustable shower curtain support arm 10.

Figure 7:
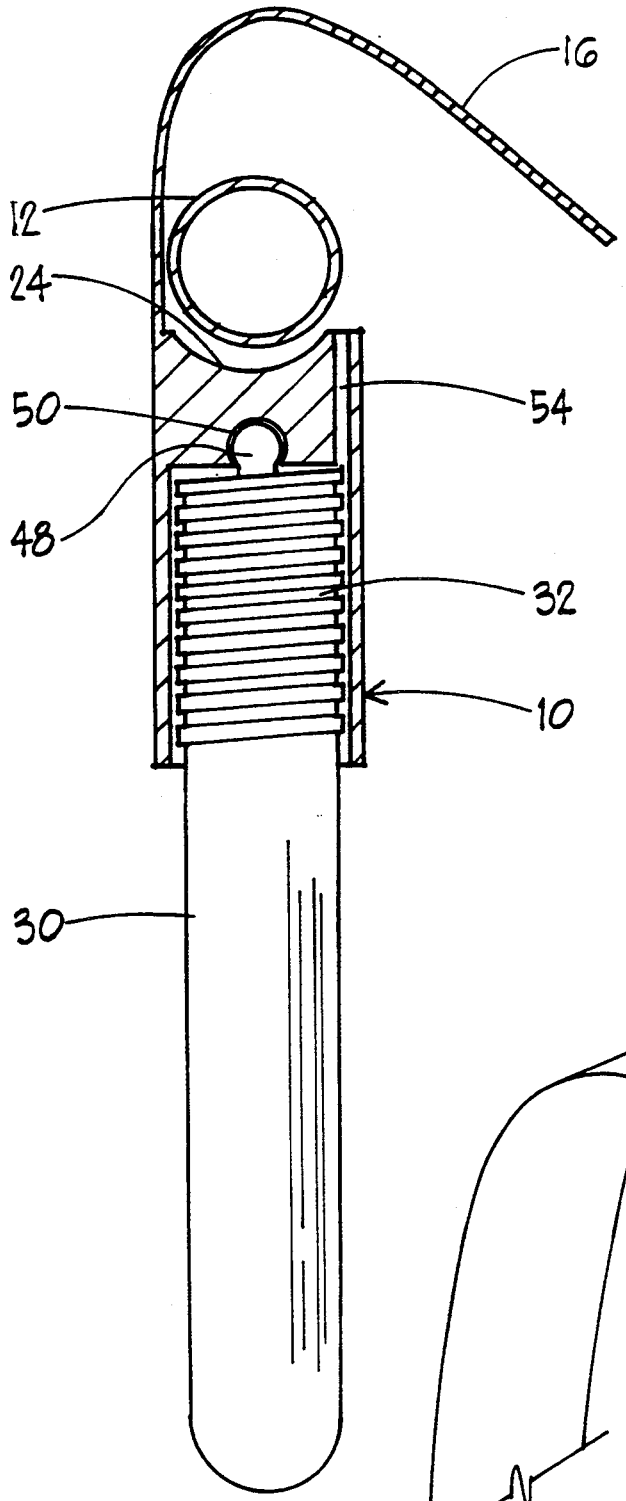
FIG. 7 is a section view showing a second embodiment of the adjustable shower curtain support arm.
Figure 8:
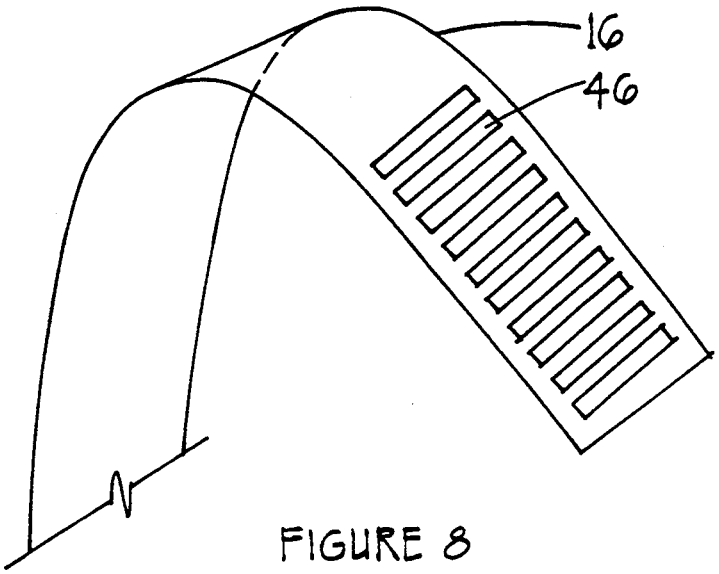
FIG. 8 shows details of the flexible member of the second embodiment of FIG. 7.

FIG. 7 shows a second embodiment of the invention. The majority of elements of this embodiment are similar to those of the preceding embodiment, however, in this case the U-shaped face for receiving curtain rod 24 is stationary and formed as an integral part of body 15. Flexible mounting member 16 is provided with notches 46 along its length of an appropriate configuration to correspond with the threads at the top of elongated member 30. The threaded end of the elongated member 32 has at its uppermost end a ball 48 that fits into a socket 50 within the housing, thus attaching elongated member 30 to body 15, and also allowing elongated member 30 to rotate freely in housing 14. To attach the adjustable shower curtain support arm 10 to rod 12, the flexible mounting member 16 is wrapped around shower curtain rod 12, then fed into channel 54 at the opposite side of body 15 while rotating the end of elongated member 30 at which point the notches on strap 46 engage the threaded end of elongated member 30. While continuing to turn, the elongated member 30 begins to draw itself tight around the rod 12 and force rod 12 into the U-shaped face 24 of body 15, thus firmly locking the adjustable shower curtain support arm 10 to the rod 12 at a desired position. The adjustable shower curtain support arm 10 is unlocked from the aforesaid operating position by rotating the elongated member 30 in the reverse direction.

As described in the above embodiments, the adjustable shower curtain support arm of the present invention effectively controls the positioning of a shower curtain so as to maintain the shower curtain away from contact with a bather and increase the area within the shower enclosure. The present invention accomplishes the aforesaid control of the shower curtain with a device that is controlled by manipulating an end of the elongated member.

The adjustable shower curtain support arm of the present invention can be easily mounted on a shower curtain rod without requiring the removal of the shower curtain from the rod.

The present invention, when mounted on a shower curtain rod in the non-operating position, is loosely attached to the shower rod and does not interfere with or hinder the opening and closing of the shower curtain, but rather travels smoothly along the rod in conjunction with the movement of the curtain attaching rings or clips. Furthermore, the present invention does not damage or deface the shower curtain rod.

The device of the present invention can be easily operated by bathers of less than average height and strength, including those having physical disabilities.

The present invention has been described in the above embodiments as having a strike and screw arrangement, it is to be understood, however, that other means, notably nipples that ride in helical channels or the like, may be used to similar effect as the shower rod engaging system.

Although the preceding description contains many specificities, these should not be construed as limiting the scope of the invention but merely providing illustrations of some of the presently preferred embodiments of this invention.

What is claimed is:

1. An adjustable shower curtain positioning device for use with a shower curtain rod, including;

a body member having first and second opposed ends, a curved face at said first end of said body member for receiving a curved portion of the curtain rod, a flexible strap having a proximal end extending integrally from said first end of said body member and including a distal end;

a channel formed in said body member, said channel having a first end opening disposed adjacent to said curved face, said channel being dimensioned to receive said distal end of said flexible strap in freely translating fashion;

a bore extending into said second end of said body member in a transverse relation to said curved face, said bore communicating with a second end opening of said channel, said bore including an inner end wall having a socket receptacle formed therein;

a handle member, including a shaft having integrally formed exterior threads adjacent to one end, said one end being dimensioned to be received in said bore, said one end including a distal end wall having a member adapted to engage said socket receptacle in said bore in freely rotatable fashion to secure said shaft in said bore;

said distal end of said flexible strap including a plurality of notches formed therein in serially adjacent, parallel disposition, said notches adapted to be engaged by said exterior threads of said handle;

said strap having sufficient length to circumscribe the shower curtain rod and extend into said channel to engage said threaded portion with said notches and permit tightening and loosening of said strap about said rod by rotation of said handle to clamp the shower curtain rod against said curved face.

2. The adjustable shower curtain positioning device of claim 1, wherein said member adapted to engage said socket receptacle comprises a ball-like member dimensioned to snap-engage said receptacle.

3. The adjustable shower curtain positioning device of claim 2, wherein said shaft of said handle member comprises a unitary member having a generally smooth outer surface, said exterior threads and said ball-like member formed integrally with said shaft.

4. The adjustable shower curtain positioning device of claim 1, wherein said body member comprises a unitary member having said curved face, said flexible strap, said channel, said bore, and said socket receptacle formed integrally in said body member.

* * * * *